US006332512B1

(12) United States Patent
Muranaka

(10) Patent No.: US 6,332,512 B1
(45) Date of Patent: Dec. 25, 2001

(54) CHAIR TYPE STAIR ELEVATING DEVICE

(75) Inventor: Masaru Muranaka, Osaka (JP)

(73) Assignee: Kumalift Co., Ltd., Osaka (JP)

( * ) Notice: Subject to any disclaimer, the term of this patent is extended or adjusted under 35 U.S.C. 154(b) by 0 days.

(21) Appl. No.: 09/431,261

(22) Filed: Nov. 1, 1999

(30) Foreign Application Priority Data

Nov. 2, 1998 (JP) ..... 10-312305
May 18, 1999 (JP) ..... 11-137110

(51) Int. Cl.[7] ..... B66B 9/08

(52) U.S. Cl. ..... 187/201; 187/245; 187/270; 104/118

(58) Field of Search ..... 187/201, 200, 187/245, 270; 414/921; 104/118–121, 108

(56) References Cited

U.S. PATENT DOCUMENTS 5,269,227 * 12/1993 Warren et al. ..... 187/201
5,967,265 * 10/1999 Bruno et al. ..... 187/201
6,082,496 * 7/2000 Bovis et al. ..... 187/201

FOREIGN PATENT DOCUMENTS

2434009 * 2/1976 (DE) ..... 187/201
002556534 * 7/1977 (DE) ..... 187/201
003425998 * 1/1986 (DE) ..... 187/201
003934431 * 4/1991 (DE) ..... 187/201
000043592 * 1/1982 (EP) ..... 187/201
000394201 * 10/1990 (EP) ..... 187/201
403061278 * 3/1991 (JP) ..... 187/201
406156945 * 6/1994 (JP) ..... 187/201
001740295 * 6/1992 (RU) ..... 187/201

* cited by examiner

*Primary Examiner*—Robert P. Olszewski
*Assistant Examiner*—Steven B. McAllister
(74) *Attorney, Agent, or Firm*—Wenderoth, Lind & Ponack, L.L.P.

(57) ABSTRACT

In a chair type stair elevating device in which upper and lower rails and a rack or chain parallel to the rails are provided along the stairs, an elevating mechanism mounted on the rails is moved by a pinion or sprocket of a driving machine meshing with the rack or chain. A chair is mounted on the elevating mechanism, and the rack or chain is received in the rail in a hidden state. In this way, the rack or chain is invisible, so that the design value of the entire device improves, and it is also possible to prevent injury and soiling of clothes by the rack or chain.

10 Claims, 9 Drawing Sheets

CHAIR TYPE STAIR ELEVATING DEVICE

BACKGROUND OF THE INVENTION

This invention relates to a chair type stair elevating device that permits ascending and descending of stairs while sitting on a chair, and more particularly a rack or chain structure as a driving means for moving a chair along a guide rail.

As a welfare device for handicapped people having difficulties in ascending and descending stairs, a chair type stair elevating device having a chair movable along guide rails provided along the stairs is provided so that it is possible to ascend and descend the stairs simply by sitting on the chair.

With a conventional chair type stair elevating device 1 shown in FIGS. 10 and 11, guide rails B are provided along the inclination of stairs A. The guide rails B comprise parallel rails 2 and 3. An elevating unit 4 is mounted on the rails 2, 3 through a plurality of guide rollers 12, 13. The elevating device 1 has a chair 9 comprising a seat 5, a footrest 6, a backrest 7 and armrests 8. By activating the elevating unit 4 by controlling a switch while seated on the chair 9, the chair moves along the rails 2, 3, so that it is possible to ascend and descend the stairs A.

As a drive system for such a chair type stair elevating device 1, a rack 10 or chain is provided parallel to the rails 2, 3, and a pinion 11 or sprocket of the driving machine provided in the elevating unit 4 is meshed with the rack 10 or chain, thereby moving the chair 9 along the rails 2, 3 by the rotation of the pinion 11 or sprocket.

Such a driving arrangement by the rack 10 and pinion 11, or chain and sprocket, is established as a driving element which can cope with both straight and curved stairs. With the arrangement of the rack 10 in a conventional chair type stair elevating device 1, as shown in FIG. 11, the rack 10 was fixed to the outer surface of the guide rail 2, which was a steel or stainless steel pipe. The arrangement utilizing a chain has a similar structure.

Chair type stair elevating devices are mostly set in homes. With the structure in which the rack 10 or chain is fixed to the outer surface of the rail 2, the entire rack 10 or chain is visible. This lowers the design value of the entire device. Also, since the rack 10 or chain is present at a position at which it can be touched by hands, the hands may touch the shaft edge of the rack or chain and be injured. Also, clothes may be soiled or get caught by the rack 10 or chain.

An object of this invention is to provide a chair type stair elevating device in which by providing a rack or a chain in a guide rail in a hidden state, the rack or chain cannot be seen from outside, so that the design value of the entire device improves, and it is also possible to prevent injury or soiling of clothes.

SUMMARY OF THE INVENTION

According to this invention, there is provided a chair type stair elevating device comprising a guide rail and a rack parallel to the guide rail provided along stairs, an elevating unit mounted on the guide rail so as to be moved along the guide rail, a driving means having a pinion meshing with the rack, and a chair mounted to the elevating unit, characterized in that the rack is received in the guide rail in a hidden state.

The guide rail may be extruded from aluminum alloy or made of a forming material. Thus it can be easily formed with a space for receiving a rack or chain and can be adapted to cope with curved stairs.

Other features and objects of the present invention will become apparent from the following description made with reference to the accompanying drawings, in which:

DETAILED DESCRIPTION OF THE PREFERRED EMBODIMENTS

Preferred embodiments of this invention are described with reference to the drawings.

[First Embodiment]

Figure 1:
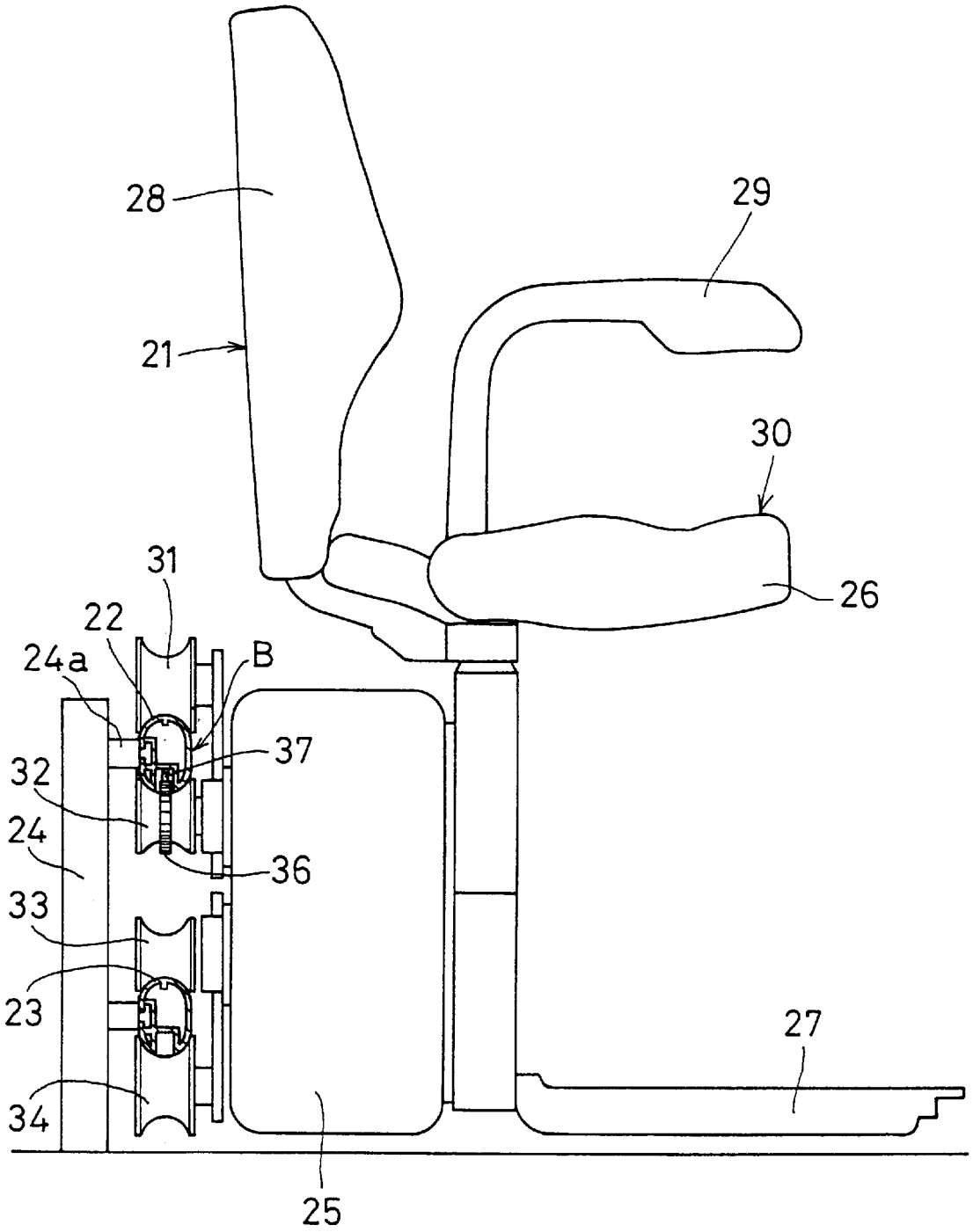
FIG. 1 is a vertical sectional side view showing a first embodiment of this invention.
Figure 2:
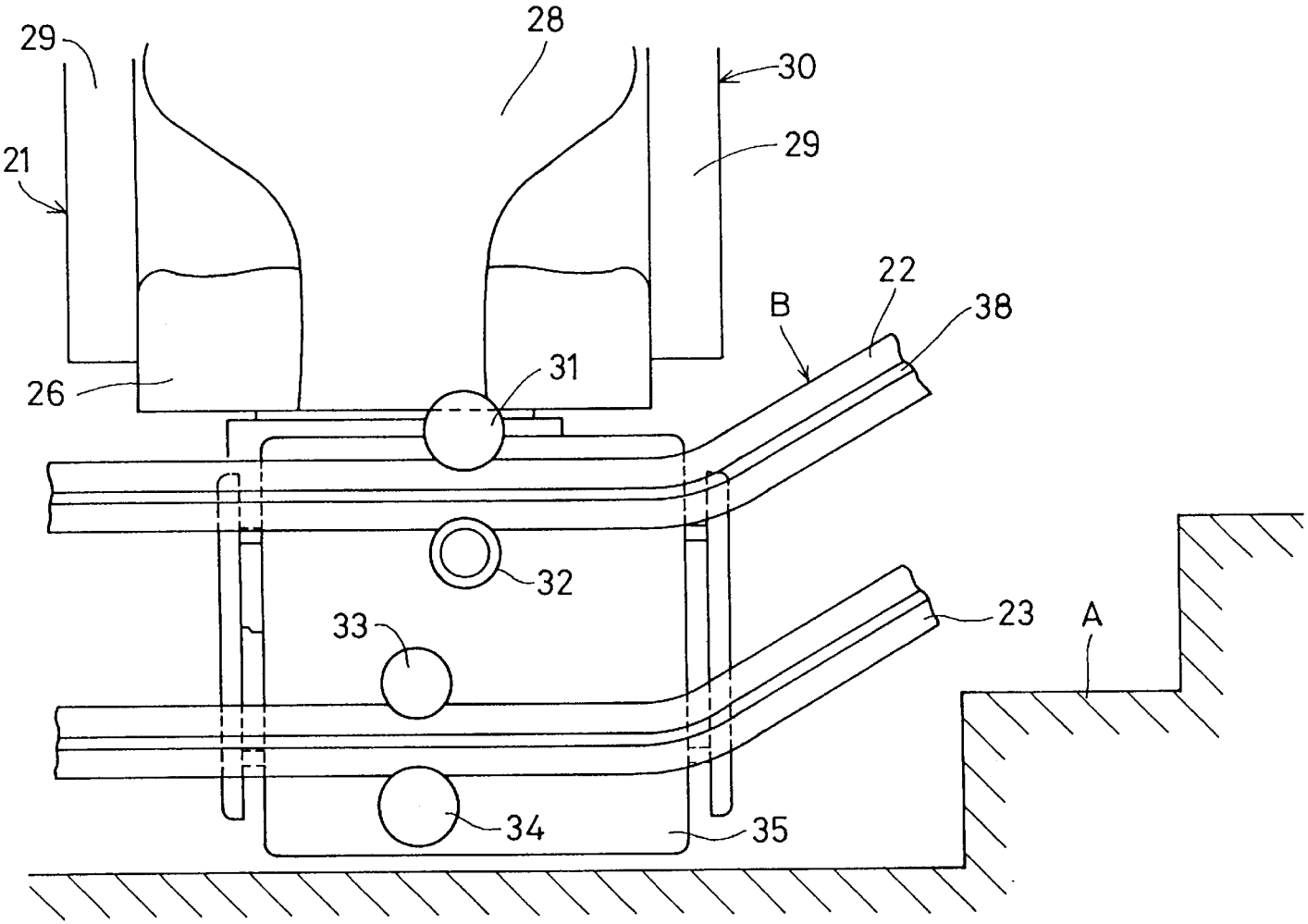
FIG. 2 is a back view of the same showing the structure of a guide rail and a guide roller.

As shown in FIG. 1, as the basic structure, a chair type stair elevating device 21 of this invention comprises guide rails B provided along stairs A including two vertically spaced apart rails 22, 23. The rails are provided parallel to each other by mounting on a rail support 24. An elevating unit 25 is mounted on the rails 22, 23 so as to be movable along the rails. A chair 30 comprising a seat 26, a footrest 27, a backrest 28 and armrests 29 is mounted to the elevating unit 25.

In the first embodiment shown in FIGS. 1 through 4, as means for moving the chair, a rack and a pinion are used.

Inside the one rail 22 of the vertically arranged rails, over the entire length thereof, a rack 37 is housed in a hidden manner so as to be parallel to the rail 22. The elevating unit 25 accommodates a motor as a driving means in a case 35 supported by the upper and lower rails 22, 23 through a plurality of guide rollers 31–34. A pinion 36 driven by the motor meshes with the rack 37. By turning on a switch provided on e.g. an armrest 29 while sitting on the chair 30, the chair is moved along the rails 22, 23 by the rotation of the pinion 36 upon the activation of the motor, so that it is possible to ascend and descend the stairs A while sitting on the chair 30.

Figure 3:
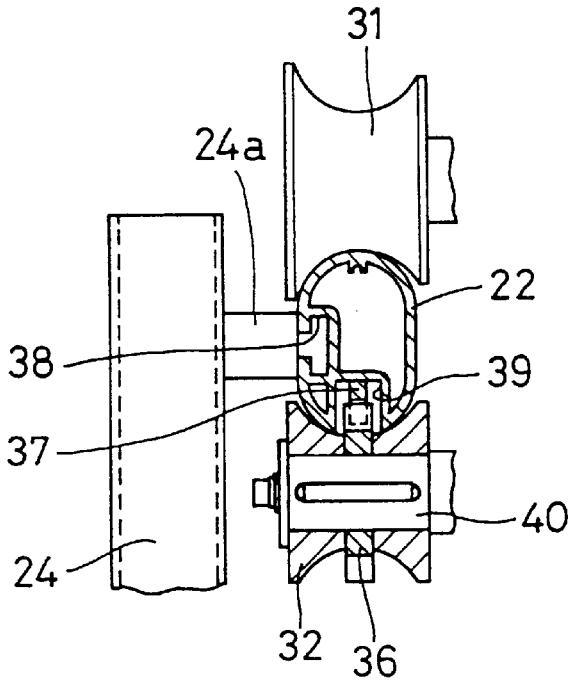
FIG. 3 is a vertical sectional side view of the same.
Figure 4:
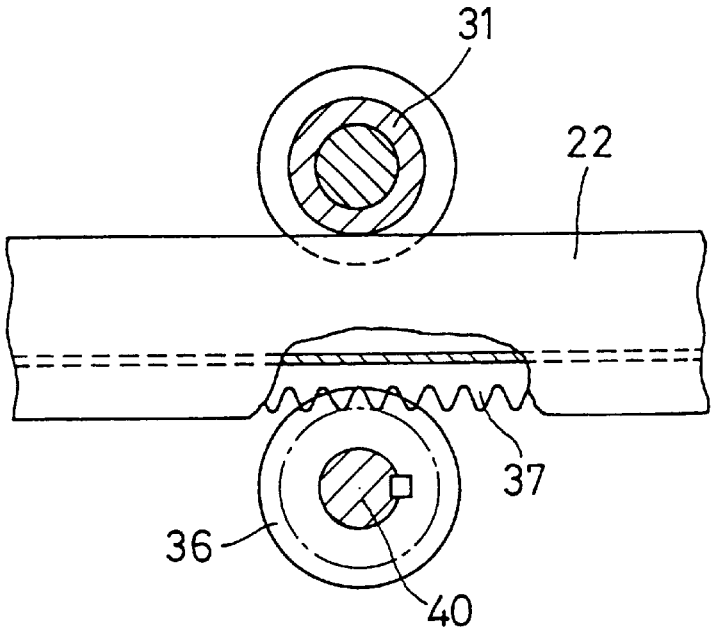
FIG. 4 is a partially cutaway front view of the same.

FIGS. 3 and 4 show how the rack 37 is mounted on the rail 22. The rail may be made of an aluminum alloy extruded into an oval pipe or made of forming material. It may have such a sectional shape that a mounting groove 38 for a support arm 24*a* of the rail support 24 is provided in one side thereof, and a groove 39 for receiving the rack 37 is provided in its bottom. The rails 22, 23 may be bent to cope with not only straight but curved stairs. The rack can be bent along the rails 22, 23.

The receiving groove 39 for the rack 37 has an angular shape of such a width and height to receive the rack 37, and is shaped so as to open at the bottom of the rail 22. The rack 37 is fixed to the top wall of the groove 39 by e.g. bolts. Received in the groove 39, the rack 37 is arranged so as to be hidden from outside, and the pinion 36 is positioned so as to mesh with the rack 37 through the bottom opening of the groove 39.

The rack 37 is fixed to the rail 22 with the rack teeth facing downward by being fixed to the top wall of the groove 39 by e.g. bolts. Also, since the rack 37 is surrounded by the rail 22, there is no possibility of the tooth face of the rack teeth being soiled by powder dust and trash and meshing of the pinion 36 being affected.

In this embodiment, the pinion 36 shares a mounting shaft 40 with a guide roller 32 abutting the bottom surface of the rail 22. As shown in FIG. 3, the guide roller 32 is divided in half with the pinion 36 arranged therebetween, and mounted on the mounting shaft 40 fixed by a key. The pinion 36 meshes with the rack 37 with the guide roller 32 abutting the bottom surface of the rail 22. When the mounting shaft 40 is driven by the motor, the guide roller 32 and the pinion 36 rotate integrally. Thus, the chair 30 moves along the rails 22 and 23.

In this embodiment, as the lower rail 23, one having the same sectional shape as the upper rail 22 is used, but one having a different sectional shape may be used.

[Second Embodiment]

Figure 5:
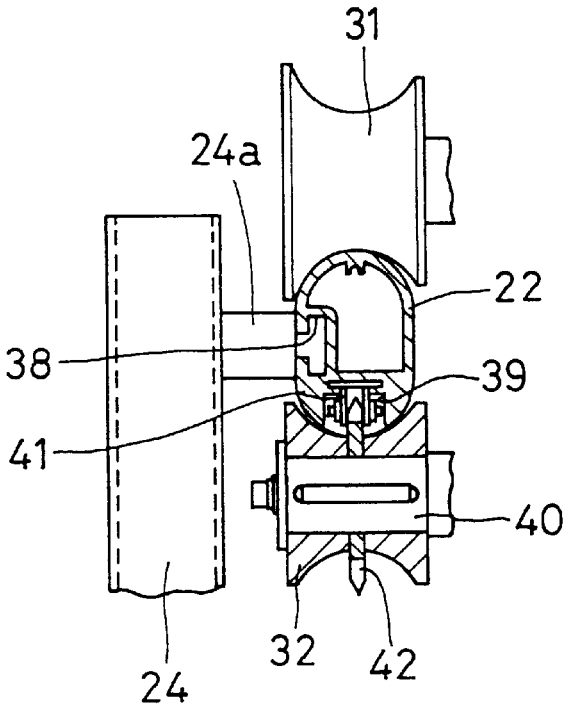
FIG. 5 is a vertical sectional side view of a second embodiment.
Figure 6:
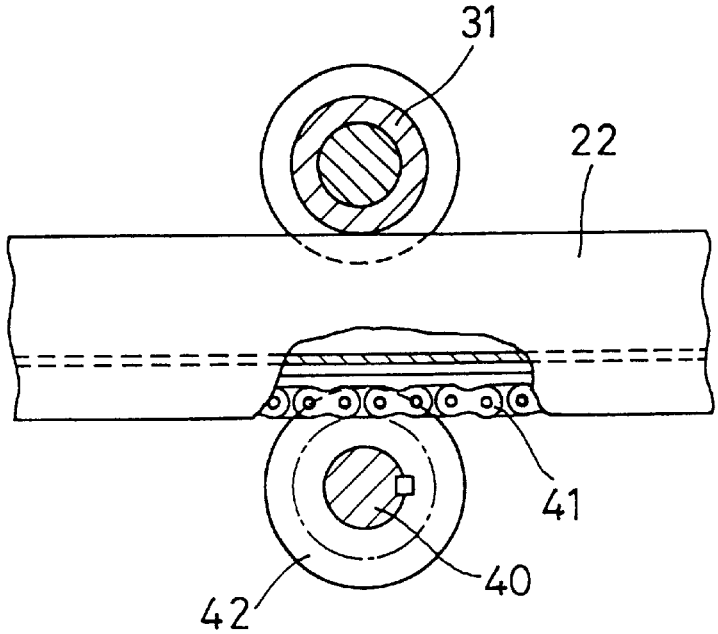
FIG. 6 is a partially cutaway front view of the same.
Figure 7:
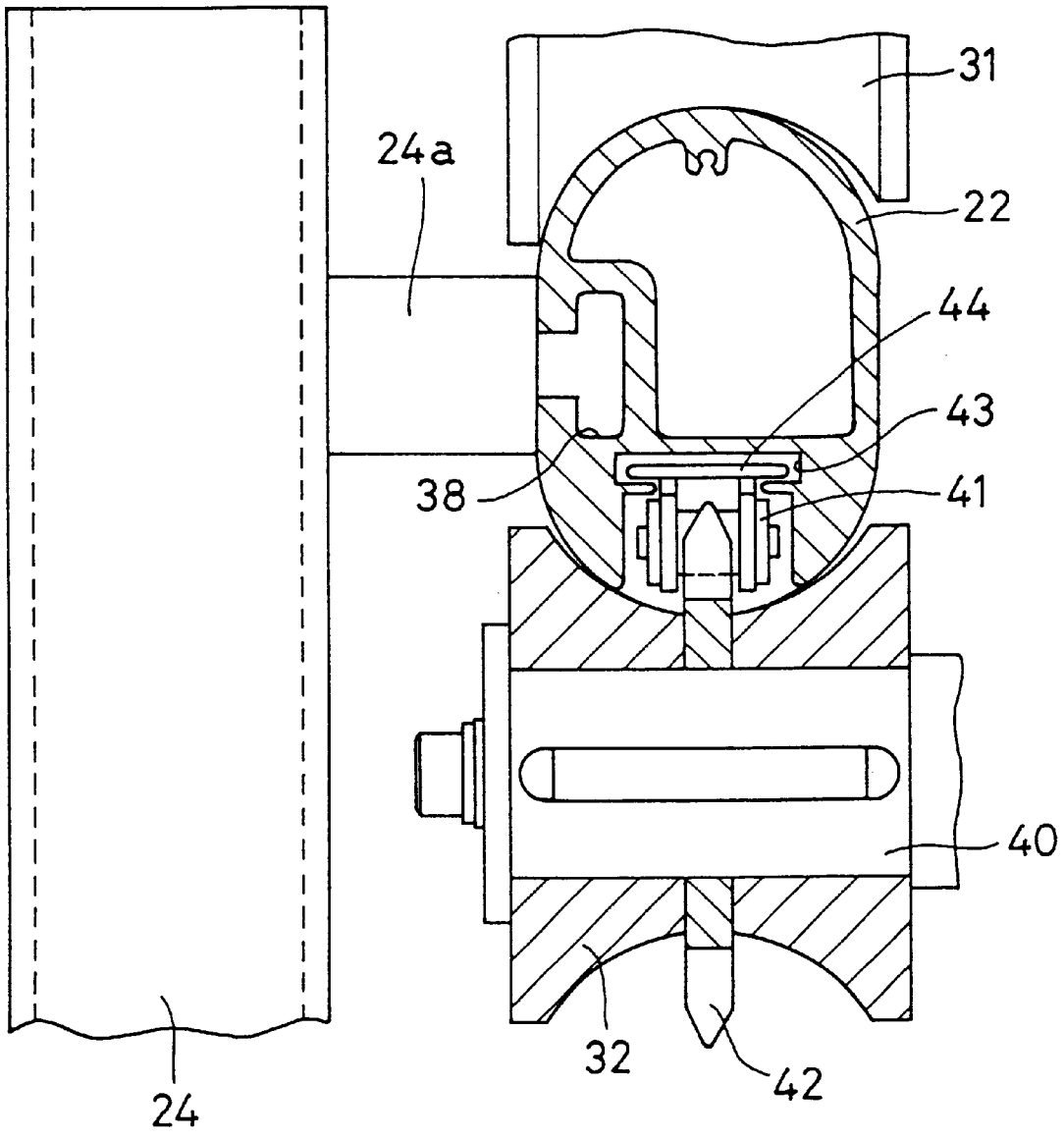
FIG. 7 is an enlarged sectional view of the structure of a chain on a guide rail.

In the second embodiment shown in FIGS. 5–7, a chain and a sprocket are used for moving the chair. For the same portions as in the first embodiment, the same reference numbers are used.

In this embodiment, the rack 37 of the first embodiment is replaced by a chain 41, and the pinion 36 by a sprocket 42. The chain 41 is received in the groove 39 of the rail 22 and fixed by e.g. bolts. The sprocket 42 shares a mounting shaft 40 with the guide roller 32 abutting the bottom surface of the rail 22, and meshes with the chain 41 to move the chair 30 along the rails 22 and 23.

By using a chain having a flexible structure as the chain 41, it is possible to cope with curved stairs. Since it is fixed facing downward in the rail 22, it is not only hidden and not visible from outside but there will be no adhesion of powder dust or trash to the meshing surface of the sprocket 42.

FIG. 7 shows how the chain 41 is mounted on the rail 22. The extruded rail 22 is formed into such a sectional shape that a guide groove 43 is integrally formed in the groove 39. A plate 44 provided over the entire length of the chain 41 is received in the guide groove 43 with opposite side edges resting on opposing ledges formed on the sidewalls of the groove, such that the chain 41 is received in the groove 39. The chain 41 is fixed to the rail 22 by e.g. bolts.

Figure 8:
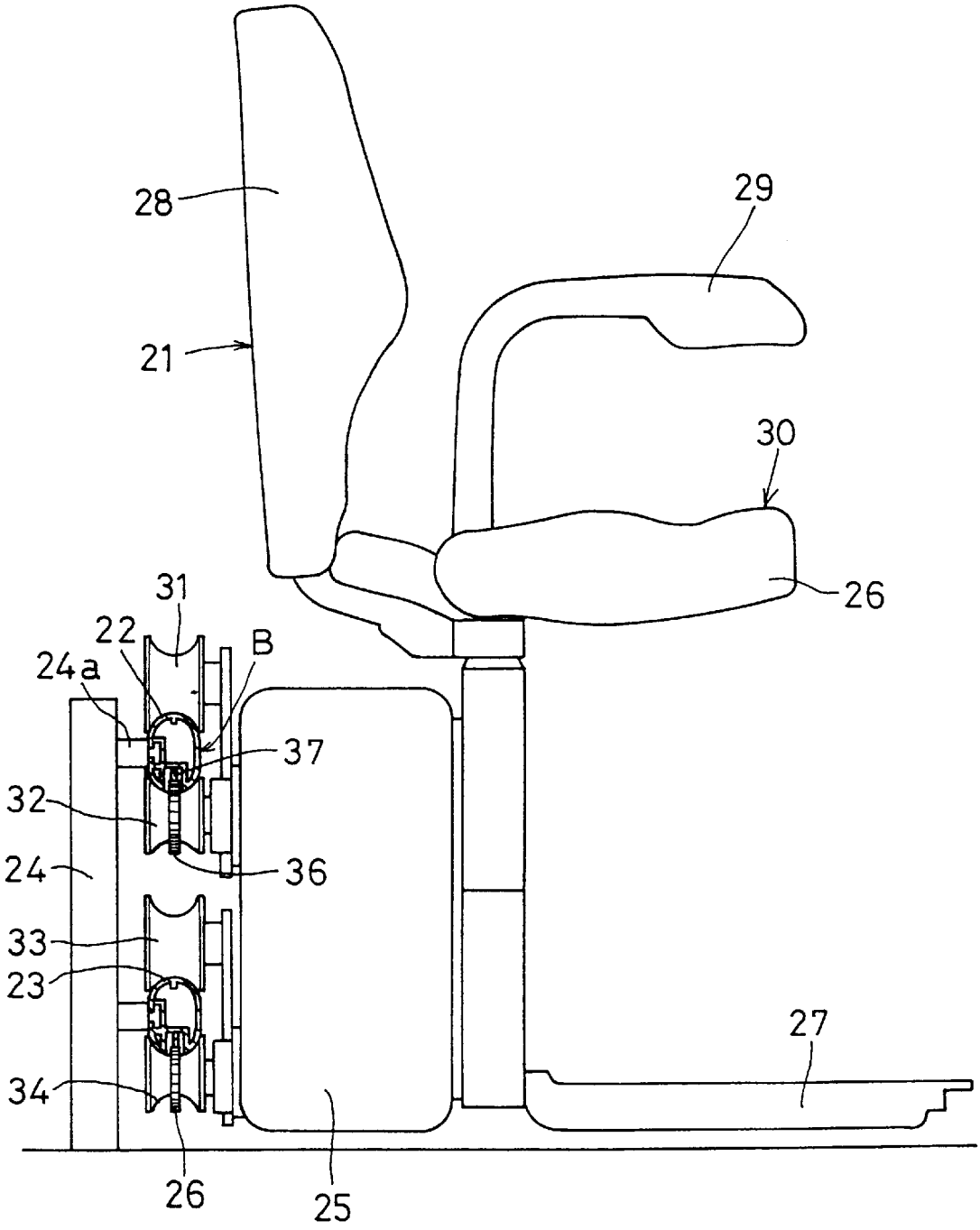
FIG. 8 is a vertical sectional side view of a third embodiment.
Figure 9:
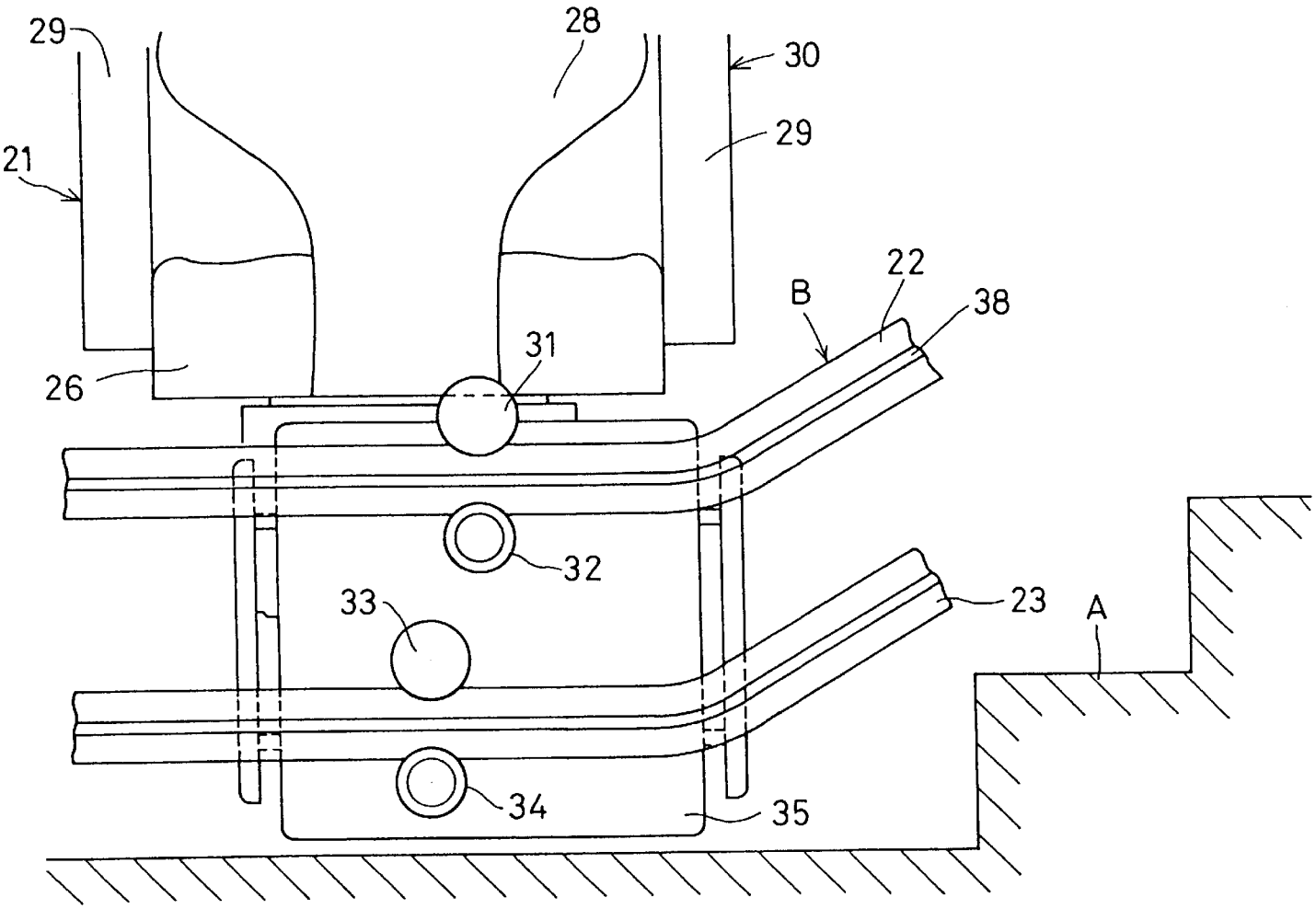
FIG. 9 is a back view of the same.
Figure 10:
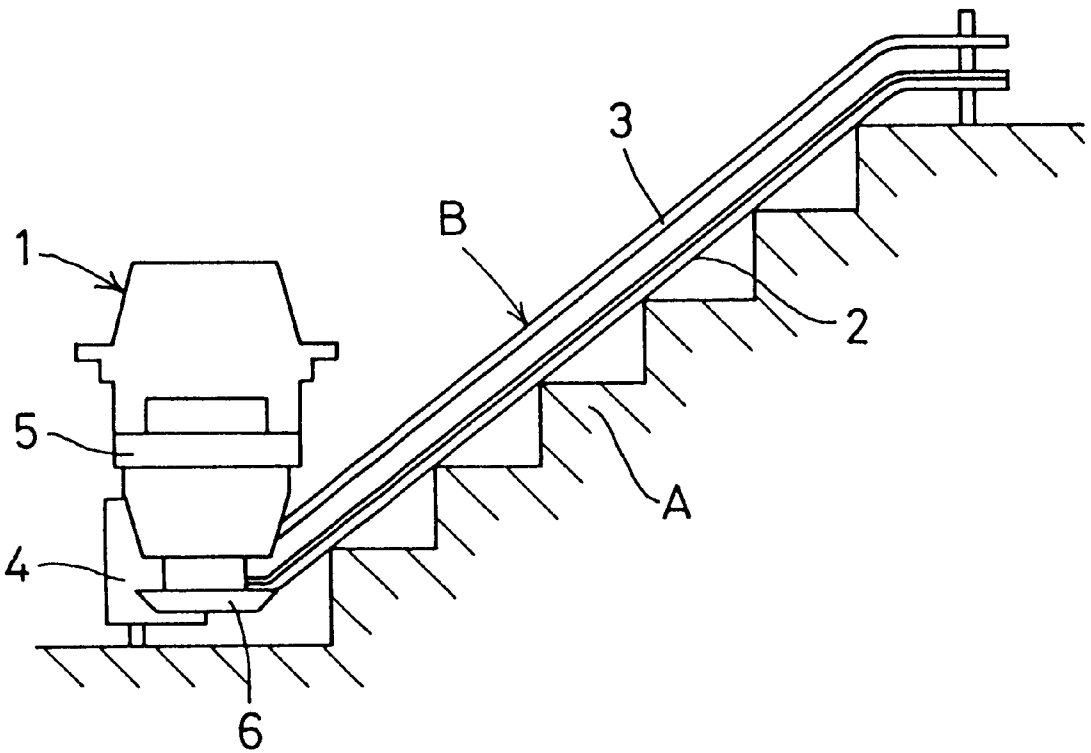
FIG. 10 PRIOR ART
FIG. 10 is a vertical sectional front view of a conventional chair type elevating device.
Figure 11:
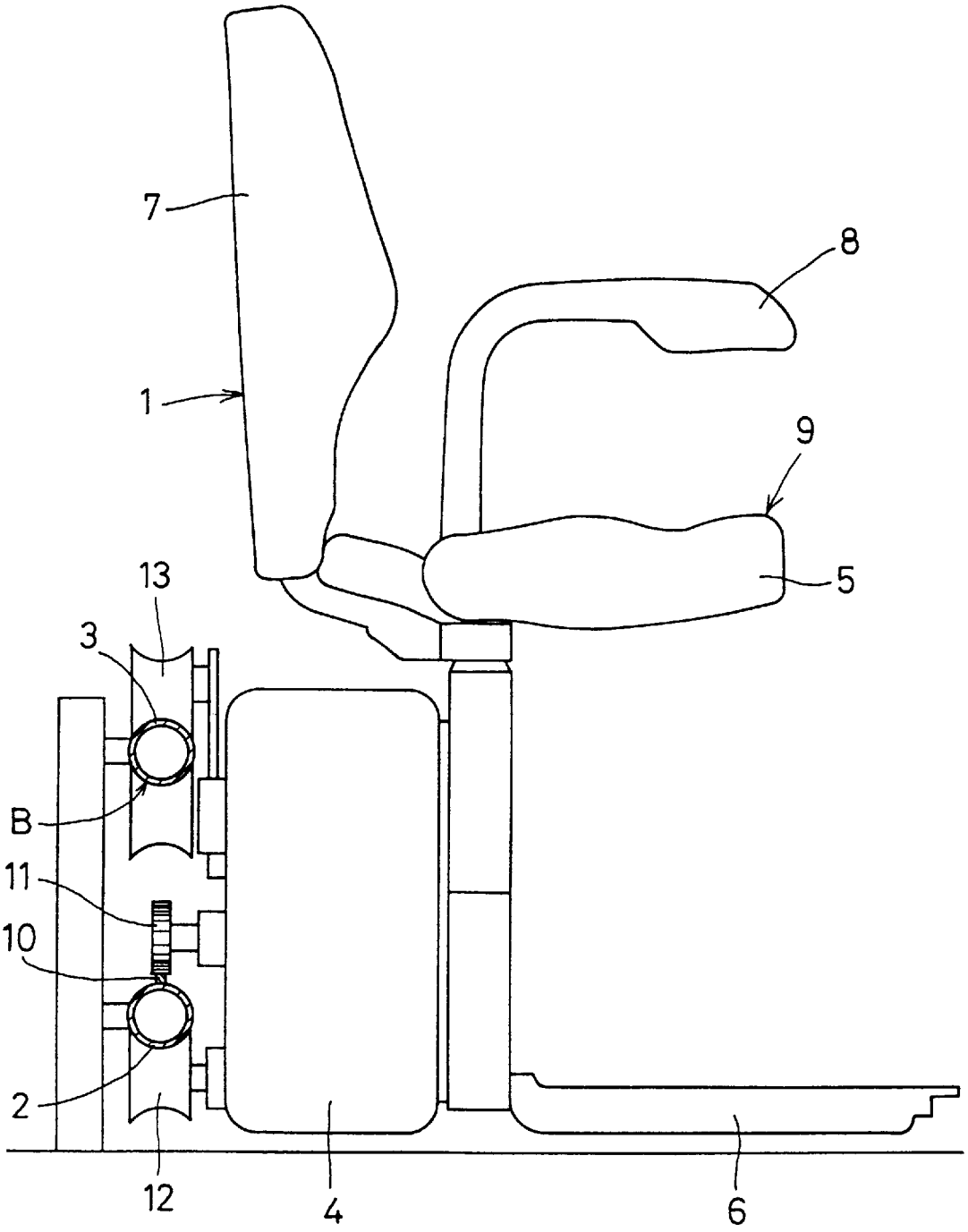
FIG. 11 PRIOR ART
FIG. 11 is a vertical sectional side view of the same.

In the third embodiment shown in FIGS. 8 and 9, a rack or chain are received in a hidden manner similar to that of the first or second embodiment in both of the upper and lower rails 22 and 23 (not in one of them as in the first and second embodiments), and the elevating unit 25 has pinions or sprockets adapted to mesh with the upper and lower racks or chains through the bottom openings of the grooves 39.

With this arrangement, drive for the movement of the chair 30 along the guide rail B becomes a double system. This prevents rolling of the chair 30. Moreover, it is possible to reduce the load on the rack or chain in half by distributing the load at upper and lower portions.

According to this invention, since the rack or chain is provided inside the guide rails in a hidden state, it cannot be seen from outside, so that the design value of the entire chair type stair elevating device is improved.

Also, by hiding the rack or chain inside the guide rails, it is possible to prevent hands from touching the rack or chain and getting hurt and prevent clothes from getting soiled or caught.

Further, since the rack or chain is fixed to the guide rails with its meshing surface facing downwardly, there is no possibility of meshing of the pinion or sprocket being badly affected due to adhesion of powder dust or trash to the rack teeth or the chain tooth surface.

What is claimed is:

1. A chair type seat elevating device comprising:

a fixed rail elongated to extend along stairs, said fixed rail having a groove formed in a bottom surface thereof and extending along its length, said groove being defined between opposing side walls, and said opposing side walls being respectively formed with opposing ledges in said groove;

a chain disposed in said groove and fixed to said rail so as to extend along said rail;

a plate fixed to a top of said chain and extending along said chain, said plate having opposite side edges respectively resting on said opposing ledges;

an elevating unit movably supported on said rail, said elevating unit carrying a rotatable sprocket engaged with said chain;

a drive unit mounted on said elevating unit and operably connected to said sprocket to rotate said sprocket; and a chair fixed to said elevating unit.

2. The chair type stair elevating device according to claim 1, wherein said opposite side edges of said plate protrude outwardly from sides of said chain.

3. The chair type stair elevating device according to claim 1, wherein said chain is disposed entirely within said groove.

4. The chair type stair elevating device according to claim 1, wherein said plate extends along an entire length of said chain.

5. The chair type stair elevating device according to claim 1, further comprising another fixed rail elongated to extend along stairs, said fixed rails extending parallel to one another and being spaced apart from one another.

6. A chair type seat elevating device comprising:

a first fixed rail elongated to extend along stairs, said first fixed rail having a first groove formed in a bottom surface thereof and extending along its length, said first groove being defined between first opposing side walls, and said first opposing side walls being respectively formed with first opposing ledges in said first groove;

a first chain disposed in said first groove and fixed to said first rail so as to extend along said first rail;

a first plate fixed to a top of said first chain and extending along said first chain, said first plate having first opposite side edges respectively resting on said first opposing ledges;

a second fixed rail elongated to extend along the stairs, said second fixed rail having a second groove formed in a bottom surface thereof and extending along its length, said second groove being defined between second opposing side walls, and said second opposing side walls being respectively formed with second opposing ledges in said second groove;

a second chain disposed in said second groove and fixed to said second rail so as to extend along said second rail;

a second plate fixed to a top of said second chain and extending along said second chain, said second plate having second opposite side edges respectively resting on said second opposing ledges;

an elevating unit movably supported on said first and second rails, said first elevating unit carrying first and second rotatable sprockets engaged with said first and second chains;

a drive unit mounted on said elevating unit and operably connected to said first and second sprockets to rotate said first and second sprockets; and a chair fixed to said elevating unit.

7. The chair type stair elevating device according to claim 6, wherein said first and second fixed rails extend in parallel to one another.

8. The chair type stair elevating device according to claim 6, wherein said first opposite side edges of said first plate protrude outwardly from sides of said first chain; and said second opposite side edges of said second plate protrude outwardly from sides of said second chain.

9. The chair type stair elevating device according to claim 6, wherein said first chain is disposed entirely within said first groove; and said second chain is disposed entirely within said second groove.

10. The chair type stair elevating device according to claim 6, wherein said first plate extends along an entire length of said first chain; and said second plate extends along an entire length of said second chain.

* * * * *